US005718263A

United States Patent [19]

Sato

[11] Patent Number: 5,718,263

[45] Date of Patent: Feb. 17, 1998

[54] PILOT OPERATED CHANGE-OVER VALVE

[75] Inventor: Hideharu Sato, Yawara, Japan

[73] Assignee: SMC Corporation, Tokyo, Japan

[21] Appl. No.: 679,116

[22] Filed: Jul. 12, 1996

[30] Foreign Application Priority Data

Jul. 26, 1995 [JP] Japan ..... 7-210125

[51] Int. Cl.[6] ..... F15B 13/043

[52] U.S. Cl. ..... 137/625.64; 137/271

[58] Field of Search ..... 137/271, 625.64

[56] References Cited

U.S. PATENT DOCUMENTS

| | | | |
|---|---|---|---|
| 3,270,776 | 9/1966 | Carls | 137/625.64 |
| 3,425,449 | 2/1969 | Leibfritz | 137/625.64 |
| 4,257,572 | 3/1981 | Neff | 137/625.64 X |
| 4,524,803 | 6/1985 | Stoll et al. | 137/625.64 |
| 5,273,074 | 12/1993 | Conradt et al. | 137/625.64 |
| 5,529,088 | 6/1996 | Asou | 137/271 X |
| 5,597,015 | 1/1997 | Asou et al. | 137/625.64 |

*Primary Examiner*—Gerald A. Michalsky

*Attorney, Agent, or Firm*—Oblon, Spivak, McClelland, Maier & Neustadt, P.C.

[57] ABSTRACT

A pilot operated change-over valve which can operate either as a double solenoid type or as a single solenoid type by replacement of part of its components, and includes a valve casing accommodating a valve member 8, a large diameter piston 12*a* and a small diameter piston 12*b*, an electromagnetic pilot valve 3*a* provided at one axial end of the valve casing 4 on the side of the large diameter piston 12*a* for driving same, and a common interfacial end face 6*b* provided at the other axial end of the valve casing 4 on the side of the small diameter piston 12*b*, the common interfacial end face being connectible either to a second electromagnetic pilot valve 3*b* for driving the small diameter piston or to an adapter plate 26 for supplying a pilot fluid constantly toward the small diameter piston.

8 Claims, 2 Drawing Sheets

PILOT OPERATED CHANGE-OVER VALVE

BACKGROUND OF THE INVENTION

1. Field of the Art

This invention relates to a pilot operated change-over valve employing an electromagnetic pilot valve for switching the position of a main valve.

2. Background Art

As for pilot operated change-over valves of this sort, two types of pilot operated electromagnetic change-over valves have been well known in the art, that is to say, a single solenoid type change-over valve incorporating a single electromagnetic pilot valve and a double solenoid type change-over valve incorporating a couple of electromagnetic pilot valves.

The double solenoid type change-over valve is provided with, in association with a main valve containing a main valve member for switching the flow direction of a main fluid, a couple of electromagnetic pilot valves for switching pilot fluid circuits to the valve member. Namely, for switching the position of the main valve member, the two pilot valves are alternately turned on and off to apply a pilot fluid pressure alternately on pistons at axially opposite ends of the main valve member.

On the other hand, the single solenoid type change-over valve is provided with, in association with a main valve containing a valve member for switch the flow direction of a main fluid, a single electromagnetic pilot valve for switching a pilot fluid flow to the valve member. In this case, the main valve member is constantly biased in one direction by a pilot fluid pressure which is supplied to one axial end of the valve member, and, at the time of switching the position of the main valve member, the pilot fluid pressure is supplied to or discharged from a piston at the other end of the valve member by turning on and off the pilot valve.

In this manner, a double solenoid type change-over valve and a single solenoid type change-over valve differ from each other in switching mechanism as well as in construction, so that it has been the general practice to use different component parts for the two types of change-over valves except for only a limited number of parts which can be shared by the two types of change-over valves. Namely, it has been considered difficult to build these two different types of change-over valves mostly by the use of commonly shared component parts.

In this regard, however, in order to facilitate change-over valve designing and fabrication processes, parts administration, maintenance and service or remodeling into a different type, or for the purpose of attaining a drastic reduction in cost, it is desirable to increase as much as possible the percentage of the component parts which can be commonly shared between change-over valves of two different types. Particularly, it is desirable to develop a change-over valve construction which can operate either as a double solenoid type or as a single solenoid type simply by replacing or changing a small number of component parts, for example, in such a way that a double solenoid change-over valve is readily remodeled into a single solenoid type simply by substituting a component part for one of solenoid valves which are assembled with a main valve.

SUMMARY OF THE INVENTION

It is a primary object of the present invention to provide a pilot operated change-over valve constructed mostly of component parts which can be commonly shared by a double solenoid type change-over valve and a single solenoid type change-over valve, permitting to alter the change-over valve easily and readily from a double solenoid type to a single solenoid type or vice versa in a reliable manner.

It is another object of the present invention to provide a pilot operated change-over valve of the sort as mentioned above, employing a couple of valve drive pistons which are arranged in such dimensional relations as will be able to produce driving forces most efficiently no matter whether the change-over valve is used as a double solenoid type or as a single solenoid type.

In accordance with the present invention, the above-stated objectives are achieved by the provision of a pilot operated change-over valve which comprises: a main valve having a valve casing with a plural number of ports for a main fluid, a valve member received within the valve casing for hermetical sliding movements therein for switching communications between the respective ports, a large diameter piston provided at one axial end of the valve member, and a small diameter piston provided at the other axial end of the valve member; and an electromagnetic pilot valve mounted on an end face of the valve casing on the side of the larger diameter piston to switch communication of a pilot chamber on the side of the large diameter piston between a pilot pressure supply passage and a pilot pressure discharge port; the valve casing being provided with a common interfacial end face at an axial end on the side of the small diameter piston, the common interfacial end face being selectively connectible to a second pilot valve for switching connection of a pilot chamber on the side of the small diameter piston between the pilot pressure supply passage and the pilot pressure discharge port when the change-over valve is to be used as a double solenoid type, or to an adapter plate for constantly communicating the pilot chamber on the side of the small diameter piston with the pilot pressure supply passage when the change-over valve is to be used as a single solenoid type.

The change-over valve, with the above-described construction according to the invention, has the main valve and one electromagnetic pilot valve on the side of the larger diameter piston assembled together in such a manner as to permit common use by a double solenoid type change-over valve and a single solenoid type change-over valve, so that it can be easily built or altered into a double solenoid type or a single solenoid type, whichever is desirable, simply by selectively mounting a second pilot valve or an adapter plate on the common interfacial end face at one end of the valve casing on the side of the small diameter piston.

According to the present invention, preferably the large and small diameter pistons are dimensioned such that they have pressure receiving areas substantially in a ratio of 2:1 for the purpose of producing driving forces most efficiently for a dual purpose change-over valve which is operated either as a double solenoid type or as a single solenoid type.

Further, according to the present invention, for each of pressure chambers in association with the large and small diameter pistons, the valve casing is provided with a manual operating means which can be manipulated to communicate each pressure chamber directly with the pilot pressure supply passage.

In case an adaptor plate is mounted on the common interfacial end face on the valve casing on the side of the small diameter piston to operate the change-over valve as a single solenoid type, part of the adapter plate is extended axially along the valve casing to cover a top surface of the manual operating means on the side of the small diameter piston.

The above and other objects, features and advantages of the invention will become apparent from the following particular description of the invention, taken in conjunction with the accompanying drawings.

DESCRIPTION OF PREFERRED EMBODIMENTS

Figure 1:
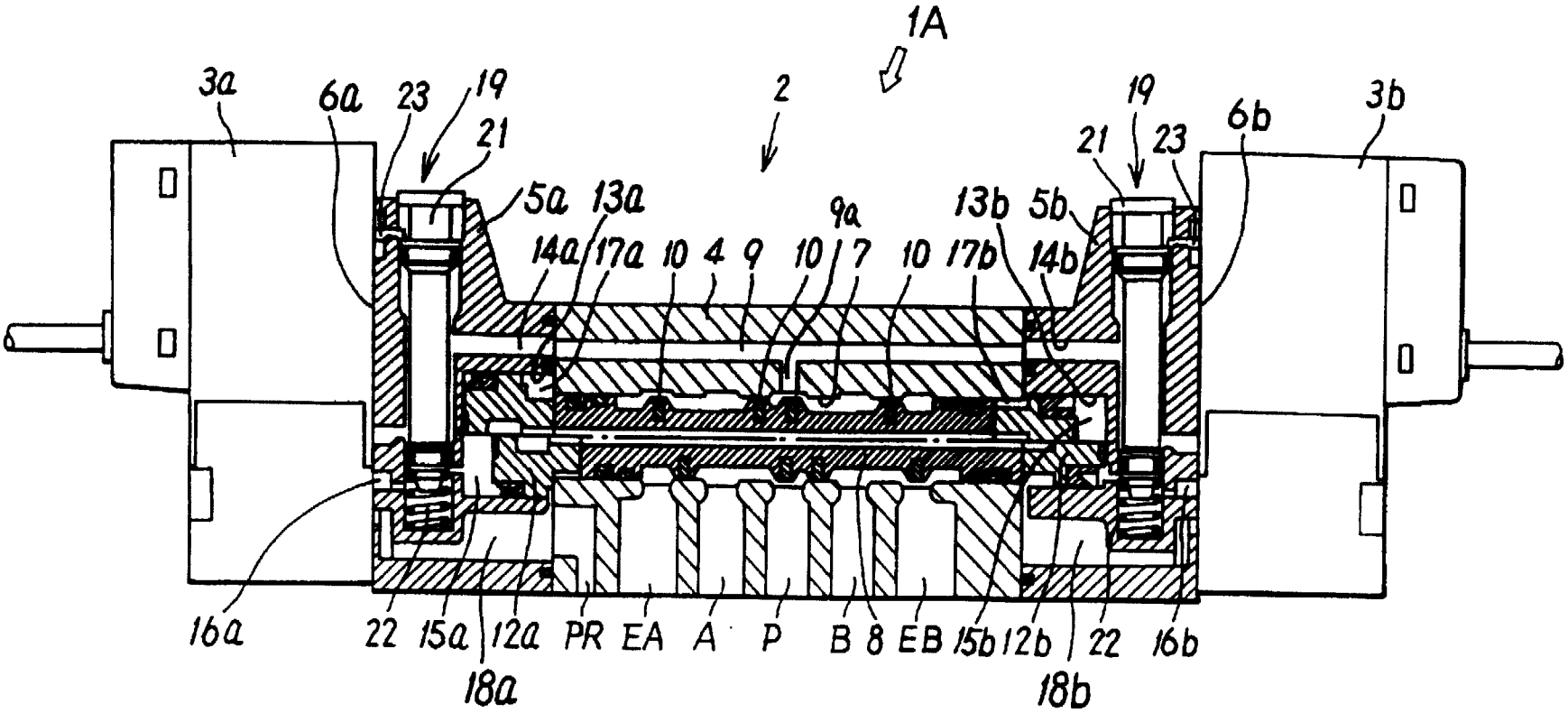
FIG. 1 is a schematic sectional view of a change-over valve according to the invention, which is adapted to operate as a double solenoid type.

Shown in FIG. 1 is a first embodiment of the invention, namely, a pilot operated change-over valve which is adapted to operate as a double solenoid type change-over valve. The pilot operated change-over valve 1A of this embodiment is largely constituted by a main valve 2 for switching a main fluid, and a couple of electromagnetic pilot valves 3*a* and 3*b* which are detachably mounted at the opposite ends of the main valve 2 by means of bolts or other suitable fixation means.

The main valve 2 is provided with a valve casing including a centrally located main casing 4, and interfacial end casings 5*a* and 5*b* which are located at and fixed to the opposite ends of the main casing 4.

The main casing 4 is provided with a supply port P for a pressurized fluid like compressed air substantially at a central position in its longitudinal direction, a couple of output ports A and B located on the opposite sides of the supply port P, a couple of exhaust ports EA and EB located further on the outer sides of the output ports A and B, a valve bore 7 formed longitudinally through the main body 4 in communication with the respective ports, a valve member 8 hermetically received in the valve bore 7 for sliding movements therein, and a pilot pressure supply passage 9 formed longitudinally through the main casing 4 and provided with a communicating passage 9*a* for communication with the above-mentioned supply port P.

The valve member 8 is of the spool type with a seal member 10 fitted around its circumference to switch connections of the output ports A and B to and from the supply port P and the exhaust port EA or EB as it is reciprocated within the valve bore 7 under the influence of the actions of a pilot fluid pressure.

The pilot valves 3*a* and 3*b* are 3-port electromagnetic valves of known construction and, although their internal constructions are omitted in the drawings, are each provided with a pilot supply port in communication with the supply port P through the pilot supply passage 9 and an outer pilot supply passage 14*a* or 14*b*, a pilot output port to output a pilot fluid to a pilot chamber 15*a* or 15*b* behind a piston 12*a* or 12*b*, and a pilot discharge port to discharge therethrough the pilot fluid in the pilot chamber 15*a* or 15*b*. As the solenoids 3*a* and 3*b* are alternately turned on and off, the respective pilot output ports are alternately connected to the pilot supply port and the pilot discharge port.

The pilot discharge ports of the above-described two pilot valves 3*a* and 3*b* are in communication with a pilot discharge port PR which is opened in the main valve casing 4, respectively through pilot discharge passages 18*a* and 18*b*.

The two pilot valves 3*a* and 3*b* are preferred to be identical with each other in construction, so that they can be attached to either end of the main valve 2. Similarly, the outer interfacial end faces 6*a* and 6*b* of the two end casings 5*a* and 5*b* of the main valve 2 are desired to be of the same construction for the same reason.

One end casing 5*a* is provided with a piston chamber 13*a* of a large diameter on its inner end face to be assembled with the main casing 4, the large diameter piston chamber 13*a* being located contiguously on the outer side of the valve bore 7 of the main casing 4. Received for hermetical sliding movements within the piston chamber 13*a* is a large diameter piston 12*a* in abutting engagement with one end of the valve member 8.

Similarly contiguously with the valve bore 7, the other end casing 5*b* is provided with a piston chamber 13*b* of a small diameter on its inner end face to be assembled with the main casing 4. A piston 12*b* of a small diameter is received in the piston chamber 13*b* for hermetical sliding movements therein in abutting engagement with the other end of the valve member 8.

Preferably, the above-described large and small diameter pistons 12*a* and 12*b* are formed in a diametral ratio of 2:1, in other words, to have pressure receiving areas in a ratio of 2:1.

The end casings 5*a* and 5*b* are provided with, in addition to the afore-mentioned pilot supply passages 14*a* and 14*b* which communicate the pilot supply passage 9 with the pilot supply ports of the respective pilot valves 3*a* and 3*b*, pilot output passages 16*a* and 16*b* which communicate the pilot chambers 15*a* and 15*b* with pilot output ports of the pilot valves 3*a* and 3*b*, and pilot discharge passages 18*a* and 18*b* which communicate pilot discharge ports of the pilot valves 3*a* and 3*b* with the outside through the pilot discharge port PR, along with respiratory chambers 17*a* and 17*b* formed between the valve member 8 and the piston 12*a* or 12*b*.

Further, each one of the end casings 5*a* and 5*b* of the main valve 2 is provided with a manual operating means 19, including an operating button 21 which can be manually pushed down to communicate the pilot chamber 15*a* or 15*b* directly with the pilot supply passage 14*a* or 14*b* while blocking communication between the pilot output passage 16*a* or 16*b* and the pilot chamber 15*a* or 15*b*, a coil spring 22 urging the operating button 21 in the upward direction in the drawing, and a stopper 23 in engagement with a lateral side of the operating button 21 serving to delimit the stroke length of the operating button 21 while preventing the latter from falling off the end casing 5*a* or 5*b*.

The two end casings 5*a* and 5*b* are formed to have the same outer configuration and internal construction except for the piston chambers 13*a* and 13*b* which are formed in a ratio of 2:1 in diameter as described above.

In the above-described first embodiment of the invention, upon turning on the solenoid of the pilot valve 3*a* and at the same time turning off the solenoid of the pilot valve 3*b* of the change-over valve 1A, a pilot fluid is produced at the pilot output port on the side of the pilot valve 3*a* and fed to the pilot chamber 15*a* through the pilot output passage 16*a*, while a pilot fluid in the pilot chamber 15*b* on the side of the pilot valve 3*b* is discharged to the outside through the pilot discharge port PR from the pilot output passage 16*b* via the pilot valve 3*b* and a passage which is not shown in the drawing. As a result, the valve member 8 is moved to the right as indicated by a lower half portion in FIG. 1 to communicate the supply port P and the output port B with the output port A and the exhaust port EB, respectively.

When the solenoids of the pilot valves 3*a* and 3*b* are turned on and off in inverse relations with the above-described operation, the valve member 8 is moved to the left as indicated by an upper half portion in the drawing, communicating the supply port P and the output port A with the output port B and the exhaust port EA, respectively.

The pilot operated change-over valve 1A of the above-described first embodiment can be easily altered into a single solenoid type by substituting the pilot valve **3*b* on the side of the small diameter piston 12*b*** with an adapter plate which will be described hereinlater.

Figure 2:
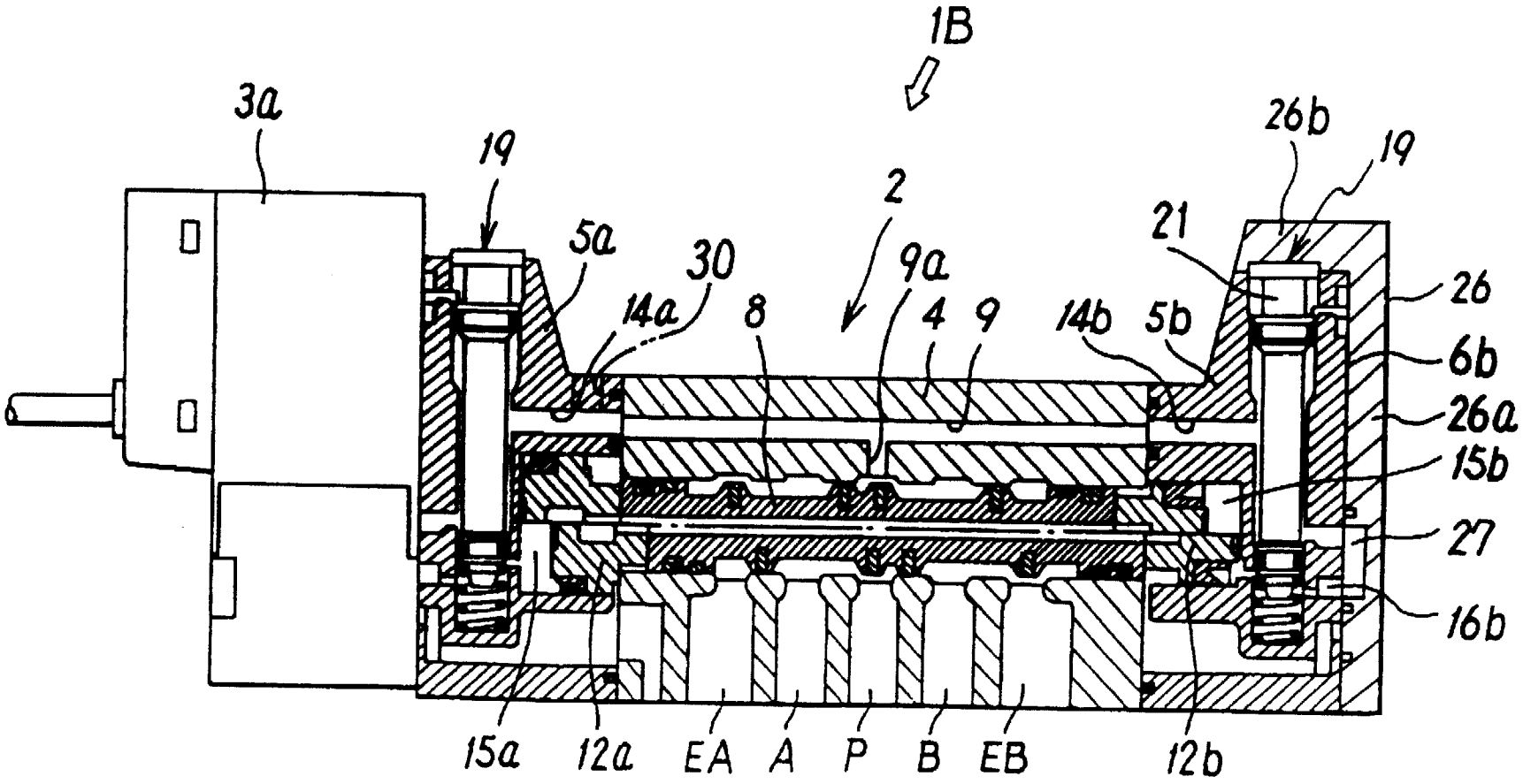
FIG. 2 is a schematic sectional view of a change-over valve according to the invention, which is adapted to operate as a single solenoid type.

Shown in FIG. 2 is a second embodiment of the invention, that is, a single solenoid type change-over valve 1B which has an adapter plate 26 mounted on the common interfacial end face **6*b* instead of the pilot valve 3*b* of the foregoing first embodiment. Accordingly, except the adapter plate 26, the change-over valve 1B is exactly same as the change-over valve 1A of the first embodiment in construction of all major components including the main valve 2 and the pilot valve 3*a***.

The adapter plate 26 is formed substantially in an inverted L-shape, having its main body **26*a* joined with the interfacial end face 6*b* of the end casing 5*b* in such a manner as to communicate the pilot supply passage 14*b* with the pilot output passage 16*b* by way of a groove 27 which is formed on the inner side of the main body 26*a*. A bent portion 26*b* at the upper end of the main body 26*a* is placed on top of the end casing 5*b* to cover the upper side of the operating button 21 of the manual operating means 19**.

Therefore, the pilot chamber **15*b* of the small diameter piston 12*b*** is constantly supplied with the pilot fluid from the supply port P.

In the above-described second embodiment of the invention, when the solenoid of the pilot valve **3*a* is in a de-energized state, the valve member 8 is moved to the left as indicated by an upper half portion in the drawing under the influence of the action of the pilot fluid pressure prevailing in the pilot chamber 15*b***, communicating the supply port P and the output port A with the output port B and the exhaust port EA, respectively.

Upon energizing the solenoid of the pilot valve **3*a*, the pilot fluid is supplied to the pilot chamber 15*a*. In this instance, since the piston 12*a* has a larger pressure receiving area than the piston 12*b*, the valve member 8 is moved to the right as indicated by a lower half portion in the drawing by the pressure differential between the two pistons despite the pilot fluid which is supplied to the pilot chamber 15*b***, as a result communicating the supply port P and the output port B with the output port A and the exhaust port EB, respectively.

In this regard, if the pressure receiving areas of the large and small diameter pistons **12*a* and 12*b* are set in a ratio of 2:1, these two pistons can produce driving forces in a ratio of 2:1 in proportion to their pressure receiving areas in case the change-over valve is used as a double solenoid type. On the other hand, in a case where the change-over valve is used as a single solenoid type, the driving force of the large diameter piston 12*a*, which moves the valve member 8 to the right in the drawing against a force acting on the small diameter piston 12*b*, is substantially equal with the driving force of the small diameter piston 12*b* which moves the valve member 8 to the left. Namely, when arranged in such dimensional relations, the large and small pistons 12*a* and 12*b*** can produce driving forces most efficiently for the dual purpose change-over valve which can operate either as a double solenoid type or as a single solenoid type.

Since both the main valve and the pilot valve on the side of the large diameter piston in the above-described valve construction can be shared by both of double and single solenoid type change-over valves, it can be easily altered from a double solenoid type to a single solenoid type or vice versa simply by selectively mounting either the second pilot valve or the adapter plate on the common interfacial end face on the side of the small diameter piston.

Thus, the change-over valve construction according to the invention makes it possible to share most of major component parts between different types of electromagnetic change-over valves, contributing to facilitate valve designing and fabrication processes as well as parts administration, maintenance, troubleshooting of component parts and remodelling into a different type of change-over valve, accompanied by substantial reductions in cost.

The replacement of a pilot valve by an adapter plate is extremely easy, so that a manufacturer can readily alter the type of change-over valve in response to the need of users. In so doing, the alteration into a different type can be accomplished in a reliable manner since the replacing component is distinctively different in appearance from one type to another to such a degree as to preclude the possibilities of mistakingly mounting a component part of one type for another type.

Although both of the above-described embodiments are of the so-called internal pilot type having a pilot fluid led into the respective pilot chambers **15*a* and 15*b* from the supply port P of the main valve 2, the present invention can be similarly applied to the external pilot type which has an external pilot fluid source other than the supply port P. For instance, as indicated by a chain line in FIG. 2, a pilot supply port 30 may be provided on either the end casing 5*a* or 5*b* in communication with the pilot supply passages 9, 14*a* and 14*b*, while closing the communication hole 9*a* which connects the pilot supply passage 9** with the supply port P.

What is claimed is:

1. A pilot operated change-over valve comprising:

a valve casing having plural ports including a supply port;

a valve member which is received in said valve casing slidably along an axial direction of said valve member and which switches communications between the plural ports, said valve member having opposite axial end portions, said valve casing having identically constructed two common interfacial end faces in an opposite direction along the axial direction;

a large diameter piston having opposite end portions in the axial direction and provided in said valve casing so as to engage with the axial end portion of said valve member at the end portion of said large diameter piston and to define a first pilot chamber at the other end portion of said large diameter piston;

a small diameter piston having a diameter smaller than that of said large diameter piston, having opposite end portions in the axial direction and provided in said valve casing so as to engage with the other opposite axial end portion of said valve member at the end portion of said small diameter piston and to define a second pilot chamber at the other end portion of said small diameter piston;

each of said common interfacial end faces having a pilot pressure supply passage communicated with the supply port and a pilot pressure output passage communicated with each of the first and second pilot chambers;

an electromagnetic pilot valve which is mounted on the common interfacial end face on the side of said large diameter piston and which controls a supply of a pilot fluid from said pilot pressure supply passage to the first pilot chamber through the pilot pressure output passage; and a pilot pressure supply unit which is mounted on the common interfacial end face on the side of said small diameter piston and which provides the pilot fluid from the pilot pressure supply passage to the second pilot chamber through the pilot pressure output passage.

2. The pilot operated change-over valve as defined in claim 1, wherein said valve casing comprises:

a main body including the plural ports and the valve member, and two end casings including said large and small pistons and common interfacial end faces, and having substantially identical shape and construction except for large and small diameter pistons, each of said end casings having a manual operating unit which communicates the each of the first and second pilot chamber with the pilot pressure supply passage directly.

3. The pilot operated change-over valve as defined in claim 2, wherein said pilot pressure supply unit comprises an additional electromagnetic pilot valve.

4. The pilot operated change-over valve as defined in claim 2, wherein said pilot pressure supply unit comprises an adapter plate having a groove which communicates with the pilot pressure supply passage and the pilot pressure output passage.

5. The pilot operated change-over valve as defined in claim 2, wherein said pilot pressure supply unit comprises an adapter plate having a groove which communicates with the pilot pressure supply passage and the pilot pressure output passage, said adapter plate being partly extended onto said valve casing to cover a top side of said manual operating unit on the side of said small diameter piston.

6. The pilot operated change-over valve as defined in claim 1, wherein said pilot pressure supply unit comprises an additional electromagnetic pilot valve.

7. The pilot operated change-over valve as defined in claim 1, wherein said pilot pressure supply unit comprises an adapter plate having a groove which communicates with the pilot pressure supply passage and the pilot pressure output passage.

8. The pilot operated change-over valve as defined in claim 1, wherein a pressure receiving area of said large diameter piston is two times as large as that of said small diameter piston.

* * * * *